United States Patent [19]

Russell

[11] 4,438,822

[45] Mar. 27, 1984

[54] CLAMP-ON DRILL COLLAR STABILIZERS

[76] Inventor: Larry R. Russell, 6025 Edgemoor, Suite, Houston, Tex. 77081

[21] Appl. No.: 306,302

[22] Filed: Sep. 28, 1981

[51] Int. Cl.[3] ..... E21B 17/00

[52] U.S. Cl. ..... 175/325; 285/18

[58] Field of Search ..... 403/374, 15; 285/342, 285/18; 175/325

[56] References Cited

U.S. PATENT DOCUMENTS

| | | | |
|---|---|---|---|
| 2,962,096 | 11/1960 | Knox | 285/18 X |
| 4,105,262 | 8/1978 | Richey | 308/4 A |
| 4,121,675 | 10/1978 | Nixon | 308/4 A X |
| 4,131,167 | 12/1978 | Richey | 308/4 A X |

FOREIGN PATENT DOCUMENTS

| | | | |
|---|---|---|---|
| 2439100 | 2/1976 | Fed. Rep. of Germany | 285/342 |

*Primary Examiner*—Stephen J. Novosad
*Assistant Examiner*—Joseph Falk
*Attorney, Agent, or Firm*—Carl B. Fox, Jr.

[57] ABSTRACT

Clamp-on drill collar stabilizers, wherein a stabilizer body in sleeve form is adapted to receive a drill collar therethrough. The stabilizer sleeve is connected to the drill collar by releasable connection means, and positive release means for releasing the connection is provided. Six embodiments of apparatus are provided, with diverse forms of connection means and release means, each adapted for quick connection and quick release, so that the stabilizer sleeve may readily be removed or moved to another location along the drill collar.

12 Claims, 6 Drawing Figures

CLAMP-ON DRILL COLLAR STABILIZERS

BACKGROUND OF THE INVENTION

In drill strings used to drill petroleum wells, one or more drill collar sections are usually provided in the string immediately above the drill bit. The drill collars are connected in the drill string and to the drill bit by threaded connections. In order that the drilling will proceed in a controlled manner, the drill collars must be stabilized to be made concentric in the drill hole and to minimize wobble of the drill bit. Stabilization of the drill collars is accomplished by connecting stabilizing devices spaced along the drill collars. It is desirable that the stabilizing devices be adapted to be affixed to the drill collars anywhere along their lengths. Accordingly, the stabilizers are usually clamped to the drill collars without means assisting the clamping provided at the drill collar exteriors.

The drill collars are in the form of elongate tubes or pipes having threaded connection means at each end. Each stabilizer is disposed around the drill collar, intermediate its length, and firmly clamped to the drill collar in a manner to resist longitudinal and rotational movements of the stabilizer. To be satisfactory in use, the stabilizers must be adapted for quick connection to the drill collar and for quick disconnection and movement along the length of the drill collar for reconnection at another location.

SUMMARY OF THE INVENTION

According to the invention, drill collar stabilizers are provided which are capable of being installed on a drill collar at any point along the length of the drill collar, and which may be quickly connected to the drill collar and quickly disconnected therefrom for removal or for movement to another location along the length of the drill collar. The stabilizer is in the form of a sleeve disposed with clearance about the drill collar, and having internal clamping or gripping means whereby the stabilizer sleeve may be clamped to the drill collar exterior. Six embodiments of drill collar stabilizers are disclosed. In each, a stabilizer sleeve is disposed freely about the drill collar and clamping or gripping means is provided between the sleeve and drill collar to connect them releasably together. In one embodiment, sets of flushly disposed spring washers are resiliently tilted to increase their radial extents to provide the required radial clamping action. In a second embodiment, rubber or other elastomeric sleeves are axially compressed to increase their radial extents to provide the required radial clamping action. In a third embodiment, helical spring elements are helically compressed and decompressed, when helically decompressed the springs providing radial contraction to provide the required gripping action on the drill collar. In a fourth embodiment, interaction between oppositely tapered wedges causes radial expansion to provide the required radial clamping action. In a fifth embodiment, longitudinal tensioning of a sleeve formed of helically disposed wires of a wire mesh causes a gripping action on the drill collar to effectively clamp it to the stabilizer sleeve. In a sixth embodiment, segmented wedge elements are clamped between the drill collar exterior and the stabilizer sleeve interior and engaged or disengaged by movement of a threaded sleeve which is mechanically interlocked with the tubular wedge.

In each embodiment, the stabilizer sleeve is effectively clamped to the drill collar exterior to be positioned against axial and rotational movements, yet is quickly and effectively positively released for repositioning of the stabilizer sleeve along the length of the drill collar, or for removal of the stabilizer sleeve. For connection and disconnection of the stabilizers, only simple tools such as spanner wrenches are required. The stabilizer in each embodiment is capable of being installed at any point along the length of a drill collar. The stabilizer may be easily moved, when desired, along the length of the drill collar. The spacings of stabilizers along the drill collar may be as desired.

A principal object of the invention is to provide drill collar stabilizers which may be installed rigidly in place at any point along the length of a drill collar, and which may be readily released to be moved to another point along the length of the drill collar. Another object of the invention is to provide such drill collar stabilizers which are secured to the drill collar by radial compressive forces. A further object of the invention is to provide such drill collar stabilizers which include means for positive release of the stabilizer from the drill collar. A still further object of the invention is to provide such a drill collar stabilizer which is fixed to the drill collar by a lengthwise tensioned tubular element. Another object of the invention is to provide such a drill collar stabilizer which is fixed to the drill collar by a helical spring member. A further object of the invention is to provide drill collar stabilizers which are simple, yet which are dependable in operation.

Other objects and advantages of the invention will appear from the following detailed descriptions of preferred embodiments, reference being made to the accompanying drawings.

BRIEF DESCRIPTIONS OF THE DRAWINGS

DESCRIPTIONS OF THE PREFERRED EMBODIMENTS

Figure 1:
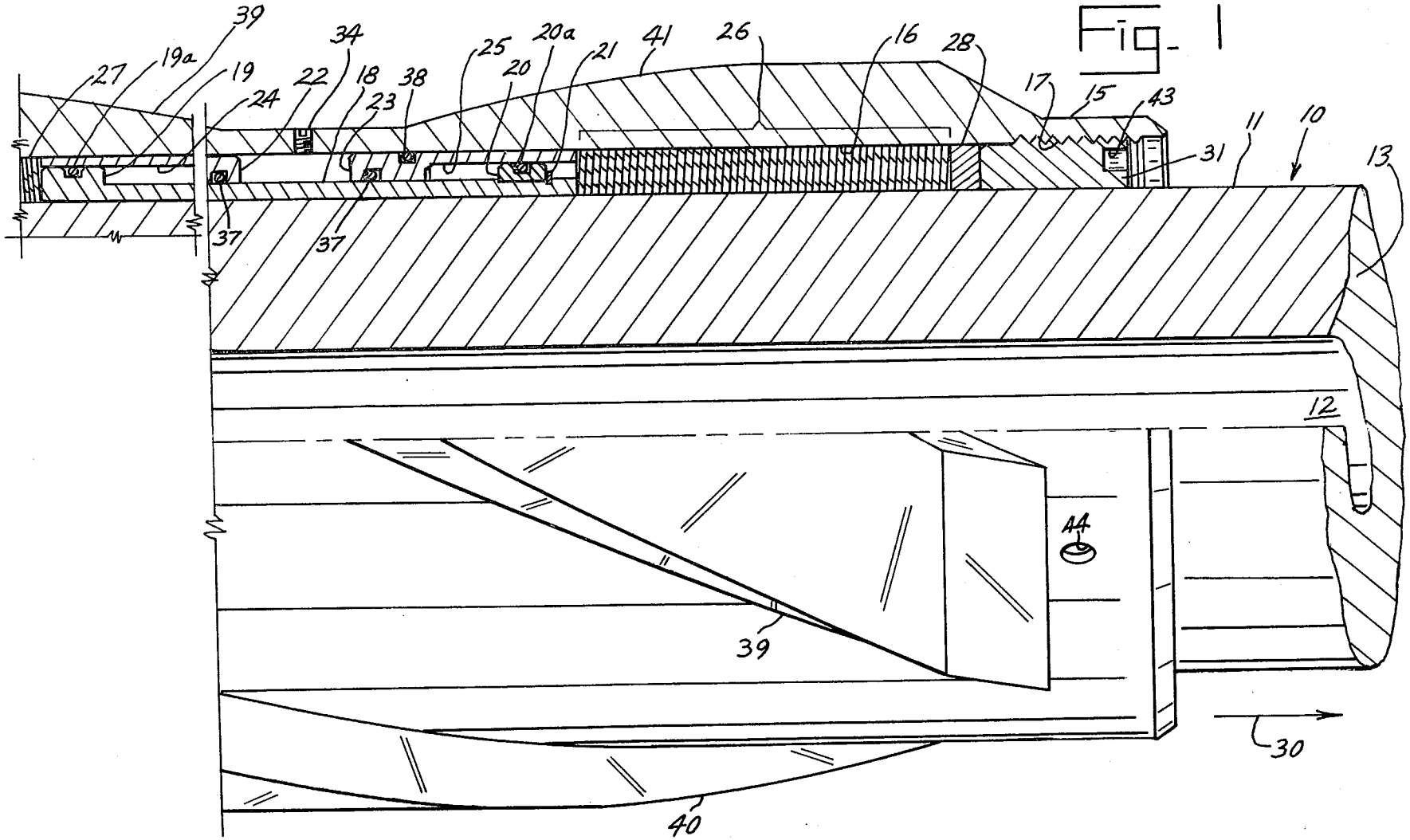
FIG. 1 is a longitudinal quarter section of a drill collar stabilizer of preferred form.

Referring now to the drawings in detail, and first to FIG. 1 which shows a first preferred embodiment of the invention, a drill collar 10 has a smooth uniform exterior surface 11, and has an axial passage 12 therethrough surrounded by the relatively thick wall 13 of the drill collar. A stabilizer sleeve 15 spacedly surrounds the drill collar, and is in the form of a tubular sleeve having a uniform bore 16 having internal threads 17 at each end. A sleeve 18, which serves as a piston holder sleeve, has an outward enlargement 19 at one end and has therearound a short ring 20 at the other end, ring 20 being retained by a shallow annular recess in which it is seated and by a Spirolox snap ring 21 at one side. Formation 19 and ring 20 have O-ring seals **19*a*, 20*a*, respectively, in suitable grooves therearound. Pistons 22, 23 are slidably disposed between piston retainer sleeve 16 and the interior of stabilizer sleeve 15 and are respectively relieved at 24, 25, where they engage formation 19 and ring 20. A first plurality of spring washers 26 are disposed flushly together between the end of piston holder sleeve 18 and a washer 28. A similar plurality of spring washers 27 is disposed at the opposite end of the apparatus. The spring washers 26, 27 are in the form of well known Belleville springs, being like flat washers except being of frustoconical configuration, as is well known in the art. Each plurality 26, 27 of such washers or springs are placed together flushly with matching angularities or tapers. Arrow 30 indicates the upward direction of the apparatus in a well. Upper clamping ring 31 is engaged in threads 17 at the upper interior of stabilizer sleeve 15. A washer 28 and clamping ring 31 are identically provided at the lower end of the apparatus. When ring 31 is screwed into threads 17 against washer 28, the washer forces the outer peripheries of the spring washers 26 resiliently downwardly, the inner peripheries of the washers being retained against sleeve 16. In other words, the spring washers 26 are bent toward flat radially disposed forms from their original frustoconical forms. This serves to increase their radial extents, so that they bear inwardly and outwardly against the drill collar and stabilizer sleeve 15, thereby acting as wedges to fix the stabilizer sleeve in position with respect to the drill collar. When it is desired to move or remove the stabilizer from the drill collar, the clamp rings 31 at the top of the apparatus and the identical threaded clamp ring (not shown) at the bottom end of the apparatus are unscrewed to relieve the pressure against the spring washers. If this does not effectively release the stabilizer sleeve with respect to the drill collar, then plug 34 may be removed and pressured fluid introduced to within the stabilizer sleeve. Such fluid pressure will act against the ring shaped pistons 22, 23 to force their extending portions against the outer peripheries of the spring washers whereby the spring washers resume their initial frustoconical forms and reduce their radial extents. Therefore, positive means is provided whereby the stabilizer may be released from the drill collars for movement to a new location or for removal. Each piston 22, 23 is provided with inner and outer O-ring seals 37, 38, respectively, disposed in suitable circular grooves therearound whereby pressure introduced upon removal of plug 34 does not leak past the pistons. The clamping sleeves 31 and the stabilizer sleeve 15 are provided with cylindrical recesses 43, 44**, respectively, at spaced points of their peripheries whereby spanner wrenches may be used to rotate them.

It is to be understood that the tool is symmetrical with respect to the upper and lower portions to either side of plug 34, except with respect to the sleeve 16 which is different at its opposite ends, as already explained. The spring washers 26 at the upper (righthand) portion of the tool tend to especially resist downward movement of the stabilizer sleeve along the drill collar while the oppositely beveled washers 27 at the bottom (lefthand) portion of the tool tend to especially resist upward movement of the stabilizer sleeve. The pressures of the spring washers inwardly and outwardly against the drill collar and the stabilizer sleeve serve also to resist rotative movements of the stabilizer sleeve with respect to the drill collar.

The stabilizer sleeve is cylindrical inwardly and outwardly, and has helically disposed ribs 39–41 at its outer surface to engage the well bore. The rib construction is provided whereby fluids may flow past the stabilizer in the well.

The ends of the elements which engage the spring washers 26, 27 may be formed of or coated with a suitable bearing material in order that twist on the rings with consequent binding will be eliminated.

Figure 2:
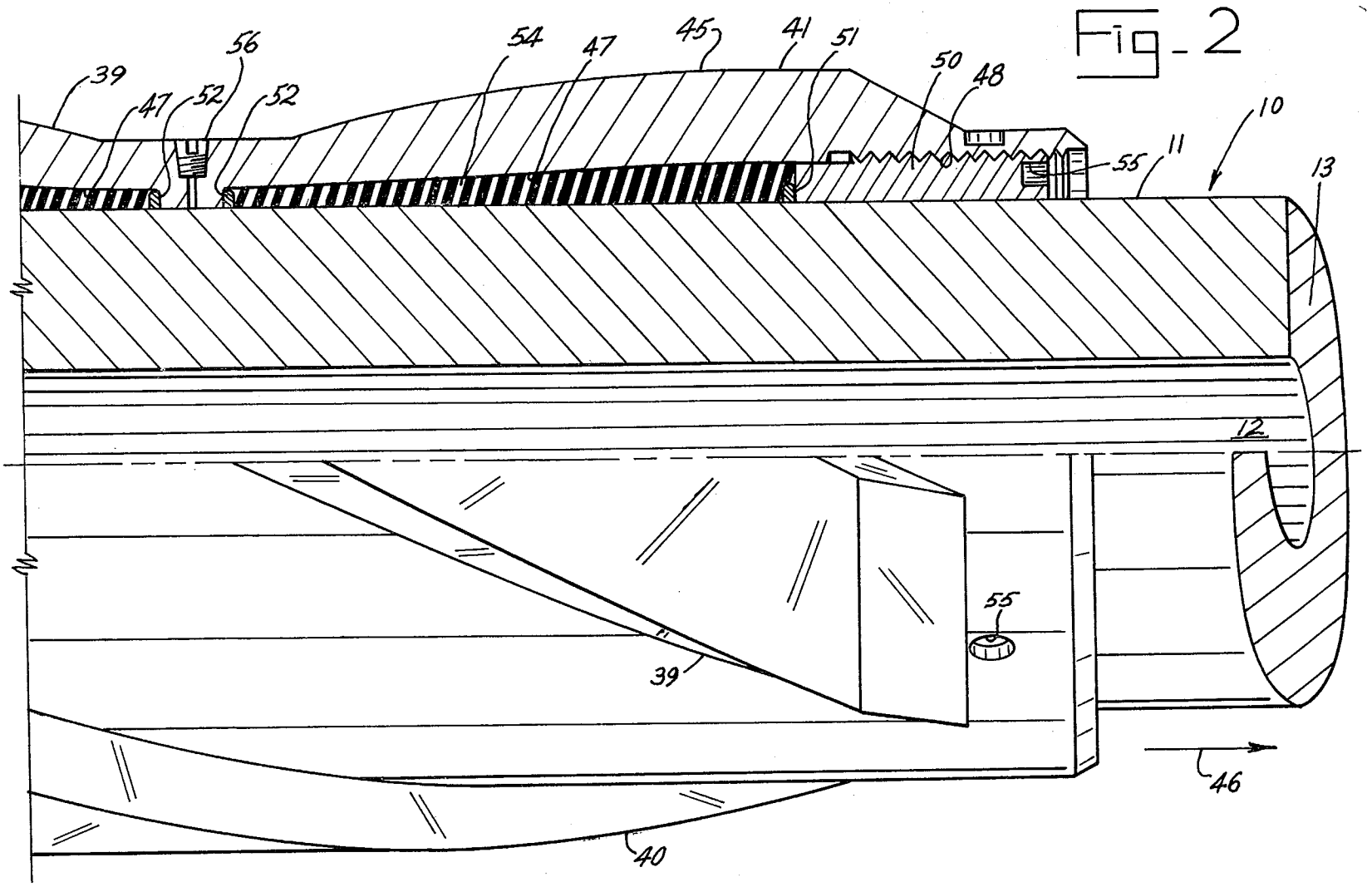
FIG. 2 is a longitudinal quarter section showing a modified form of drill collar stabilizer.

Referring now to FIG. 2 of the drawings, the apparatus embodiment shown therein includes a stabilizer sleeve 45 spaced around the drill collar 10 and of which the opposite ends are of mirror image form. The "up" direction of the apparatus is indicated by arrow 46. At each end portion of the apparatus, that is, at the upper end portion and at the lower end portion, an outwardly tapered recess 47 is provided which extends from near the center of the apparatus to its end. Each recess 47 is threaded at 48 at the portion adjacent its end, and a ring shaped end plug compression screw 50 is screwed into the threads 48 of each recess 47. One or more Spirolox anti-extrusion rings 51 are disposed around the inner periphery of each screw 50 disposed against the outer surface of the drill collar 10. Another Spirolox anti-extrusion ring is provided at 52 at the inner end of each recess 47. The space of each recess 47 between Spirolox rings 51, 52 is filled with a molded sleeve of an elastomeric material such as rubber or plastic. When each of the compression screws 50 is screwed into the threads 48 in which it is engaged forceably against the elastomeric member 54, the member 54 is shortened axially and caused to expand radially whereby it grips firmly both the stabilizer sleeve 45 and the exterior of the drill collar 10. A clamping effect is created to retain the stabilizer sleeve against movement longitudinally of the drill collar and rotatively thereof.

A plurality of cylindrical recesses 55 are provided in the outer end of each compression screw 50 and in the sleeve 45 for engagement by spanner wrenches for rotations of these elements. When each compression ring 50 is released, pressure on the elastomeric element 54 is relieved and the grip thereof against the exterior of the drill collar 10 should be released. If this release does not occur, threaded plug 56 may be removed and pressured fluid introduced to between the two elastomeric elements 57 to cause the Spirolox rings 52 and the elastomeric elements to be pushed either upwardly or downwardly. This will positively release the clamping action or grip of the elastomeric elements and cause the stabilizer sleeve to be released with respect to the drill collar.

As before, the stabilizer sleeve has integral exterior helically formed ribs or bars 39–41 at its outer surface for engagement with the well bore. The ribs, as before, permit fluid passage past the stabilizer apparatus in the well.

Figure 3:
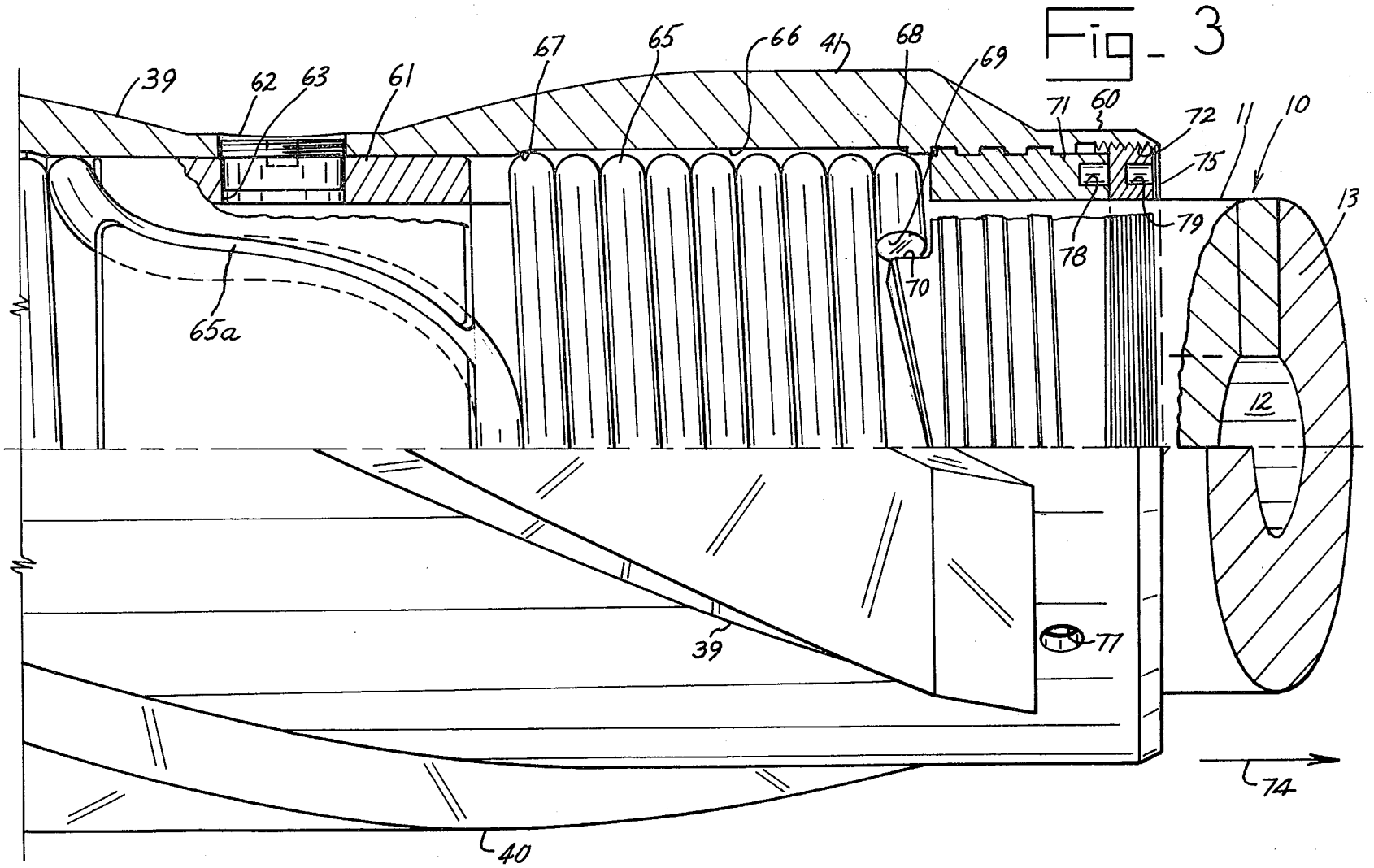
FIGS. 3–6 are longitudinal quarter sections showing four additional embodiments of drill collar stabilizers according to the invention.

In FIG. 3 of the drawings, the apparatus embodiment shown includes a tubular stabilizing sleeve 60 of cylindrical interior and exterior form, having the aforedescribed helically disposed integral ribs 39–41 at its outer surface. Sleeve 60 has clearance with drill collar 10 over its entire length. A reaction sleeve 61, which is of split ring form, is disposed centrally of stabilizer sleeve 60 and is held in place by reaction screw 62 which is screwed into a relatively large threaded opening through sleeve 60 and which extends into a mating opening 63 through sleeve 61. Sleeve 61 is of a thickness to substantially fill the space between drill collar 10 and stabilizer sleeve 60. A helical spring element 65 has symmetrical mirror image portions at each side of sleeve 61, clearance therefor being provided for annular recesses 66 which are tapered at their inner ends 67 and have outer ends 68. Each end 69 of spring element 65 engages a shoulder 70 of a disengagement driver ring 71 which has acme threads around its outer surface which engage with matching threads at the interior of each end of the stabilizer sleeve 60. Beyond the end of the acme threads at each end of the apparatus the screw threads 72 are provided into which a ring shaped jamb nut 75 is screwed to bear against the disengagement driver 71 to fix it in place. The helical spring 65 tightly engages the drill collar 10 at each end of the apparatus at opposite sides of sleeve 61 when the spring is relaxed. Arrow 74 indicates the "up" direction on FIG. 3. In order to release the pressure of spring 65 from against the drill collar, the disengagement drivers 71 are rotated to engage the shoulder 70 against the spring end 69 thereby expanding the spring and releasing the spring pressure from the drill collar. When each disengagement driver 71 is again rotated to relieve the pressure of a shoulder 71 against the spring end 69, the spring again tightens about the drill collar. Cylindrical recesses 77–79 are provided as necessary for engagment by spanner wrenches for rotation of the disengagement driver and the jamb nuts. Because of passage of spring portion 65*a* through the split or ring 61, each end of spring 65 performs independently of the other end with regard to being tightened and released from the drill collar. The disengagement drivers 71 preferably have plural shoulders 70 spaced therearound.

Figure 4:
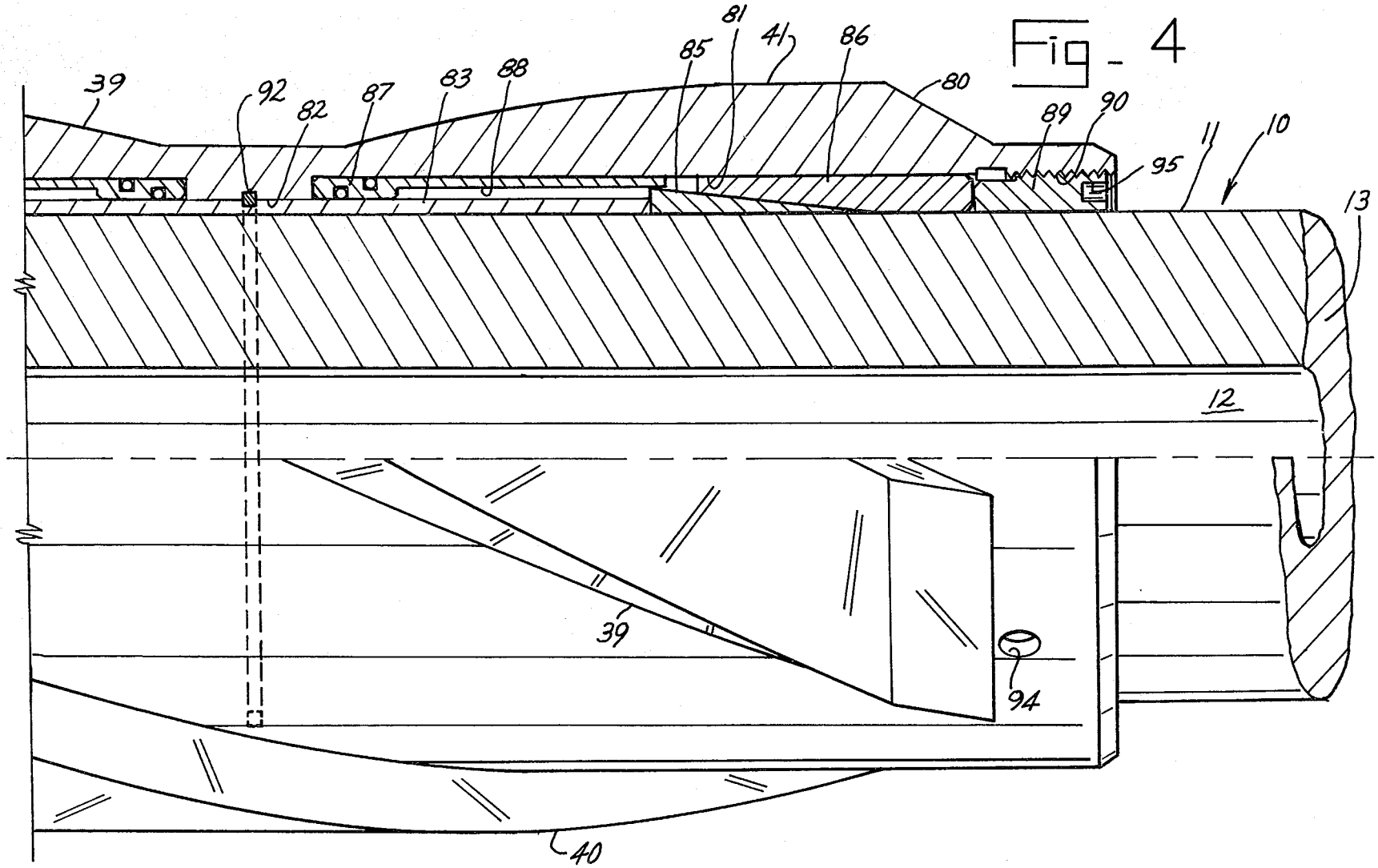

Referring now to FIG. 4 of the drawings, the stabilizer 80 is outwardly formed as before. Intermediate the length of its interior passage 81, sleeve 80 has an inwardly protruding annular portion 82 the inner side of which engages against a tubular sleeve 83 which fits closely yet slidably about drill collar 10. The apparatus is symmetrical about its center, only the righthand or upper portion being fully shown. Sleeve 83 abuts a wedge ring 85 of tapered cross section at each end, as shown. A complementary ring shaped wedge element 86 is provided about each wedge ring 85. A piston 87 which is inwardly relieved at its portion 88 is disposed against formation 82 at each side thereof. The relieved portion 88 of each piston 87 slightly overhangs the inner end of each wedge ring 85, as shown. A ring shaped compression screw 89 having exterior threads screwed into internal threads 90 at each end of the stabilizer sleeve 80 may be screwed against the end of each wedge 86 to cause it to override the associated wedge ring 85 to cause radial clamping forces at the overlapped portions of the wedges. Rings 85, 86 each has a peripheral split to accommodate radial expansions and contractions.

Sleeve 83 is held in place by a lockwire 92 of square cross section which is disposed through a rectangular recess around the apparatus, formed half in sleeve 80 and half in sleeve 83. A suitable passageway closed by a threaded plug (not shown) disposed angularly through sleeve 80 permits lockwire 92 to be inserted and retained from the exterior of the apparatus to hold sleeve 83 securely in place. Clamping of sleeve 82 to drill collar 10 is accomplished, as should be clear, by screwing in each compression screw 89, and release is obtained by screwing the locking screws outwardly in threads 90 at each end of the apparatus. In the event that the wedge 86 is not released when compression screw 89 is loosened, then the threaded plug may be removed and pressured fluid introduced through the passage to cause the two pistons 87 to move against the wedges 86 to move them away from wedges 85 whereby the stabilizer sleeve is positively released from the drill collar.

Suitable cylindrical recesses 94, 95 are provided for engagement by suitable spanner wrenches so that compression screws 89 may be screwed in and out as desired for operation of the apparatus.

Figure 5:
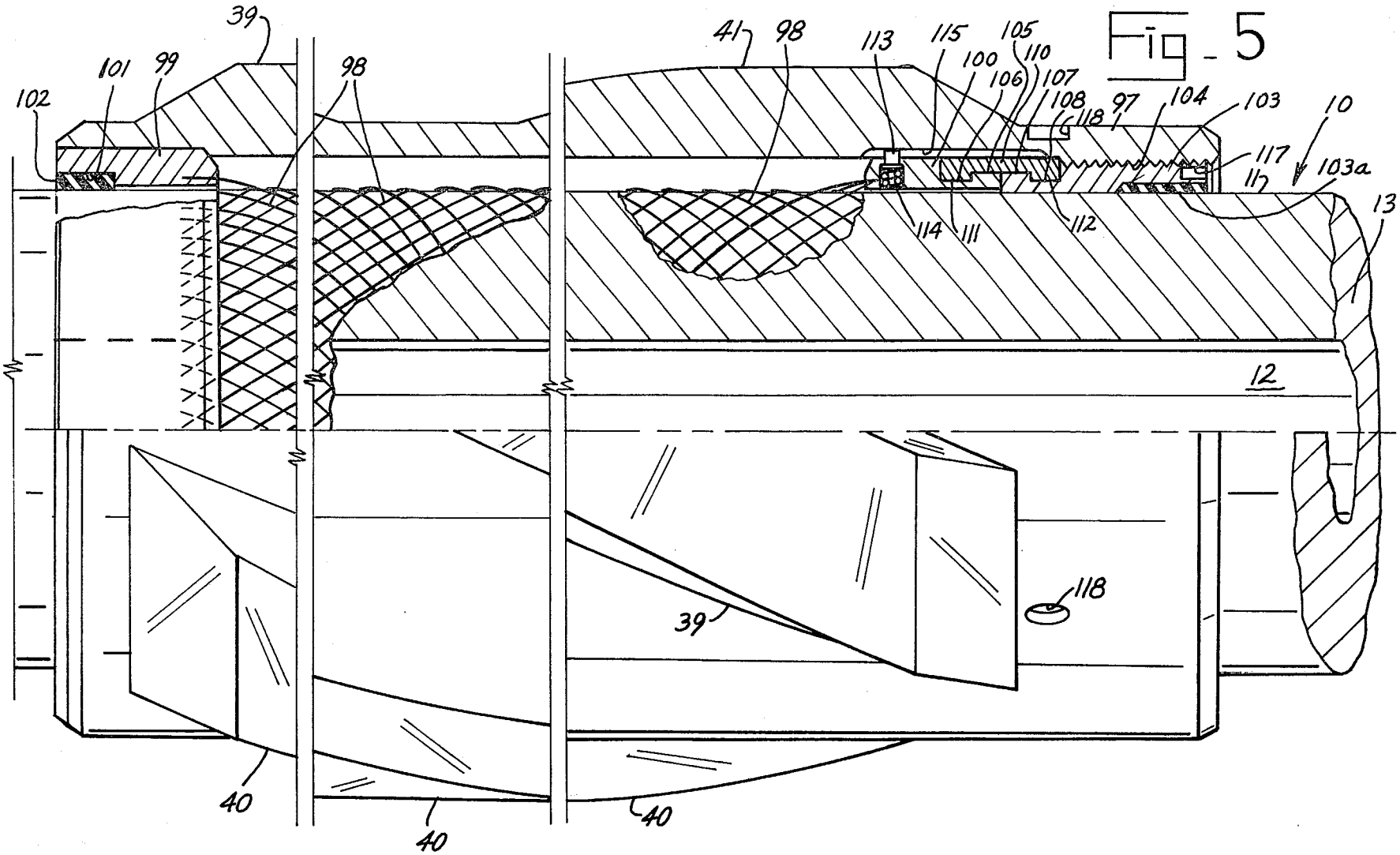

In the apparatus embodiment shown in FIG. 5 of the drawings, the stabilizer sleeve 97, as before, has helical integral ribs 39–41 formed at its outer surface. An interbraided sleeve 98 has helically disposed interwoven wires in the form of a mesh, the lower end of which is anchored in lower anchor ring 99, and the upper end of which is anchored in an upper anchor ring 100. For example, the anchor rings may be circularly slotted therearound, the sleeve ends disposed in the slots, and the anchor rings crimped to firmly hold the sleeve ends. Adhesives or other anchoring materials may be used in the slots. Rivets or screws could also be used to anchor the sleeve ends to the anchor rings. Lower anchor ring 99 has an interior end recess 101 in which is disposed a packing ring 102 of rubber or other elastomeric resilient sealing material.

Tensioning ring 103 is screwed into interior threads 104 of the stabilizer ring. Ring 103 has a packing ring 103*a* in an interior end recess therearound. Upper anchor ring 100 has outwardly relieved portion 105 and circular recess 106, while tensioning ring 103 has outwardly relieved portion 107 and circular recess 108 therearound. A split coupling ring 110 has circular annular ribs 111, 112 which are received into recesses 106, 108, respectively, and serves to couple upper anchor ring 100 and tensioning ring 103 together. A cylindrical pin 113 spring biased outward by helical compression spring 114 is slidable in axial slot 115 of the stabilizer sleeve, and prevents rotation of anchor ring 100 about its axis while enabling anchor ring 100 to move axially of the stabilizer sleeve. Plural cylindrical recesses 117, 118 permit use of spanner wrenches to hold the stabilizer sleeves stationary while tensioning ring 103 is screwed into or out of threads 104. When interbraided sleeve 98 is axially or longitudinally relaxed, it does not grip the outer surface of drill collar 10. The apparatus is assembled by placing anchor rings 99 and 100, with the interbraided sleeve 98 connected therebetween around the drill collar and with tensioning ring 103 coupled to upper anchor ring 100 by split coupler ring 110. The stabilizer sleeve 97 is then moved downwardly over these parts and tensioning ring 103 screwed upwardly in threads 104. Slot 115 is disposed in the vicinity of pin 113, and relative rotations between the pin 113 and stabilizer sleeve 97 causes the pin 113 to enter slot 115.

When tensioning ring 103 is screwed upwardly in threads 104, interbraided sleeve 98 is tensioned causing its diameter to be decreased so that it is brought into gripping contact with the outside of drill collar 10. The greater the elongation of interbraided sleeve 98, the greater its gripping force on the drill collar. Screwing tensioning ring 103 downwardly in threads 104 causes relaxation of the interbraided sleeve 98, causing it to release its grip on the drill collar. It will be understood that increased friction creating means, such as keys or pins may be provided at the interior of interbraided sleeve 98 to increase its gripping action on the drill collar. It will be clear that the apparatus shown in FIG. 5 may be clamped on a drill collar at any point along its length, and the apparatus may be released by screwing down on tensioning ring 103 so that the apparatus may be moved to another location along the drill collar and reclamped by again screwing tensioning ring 103 upwardly.

Figure 6:
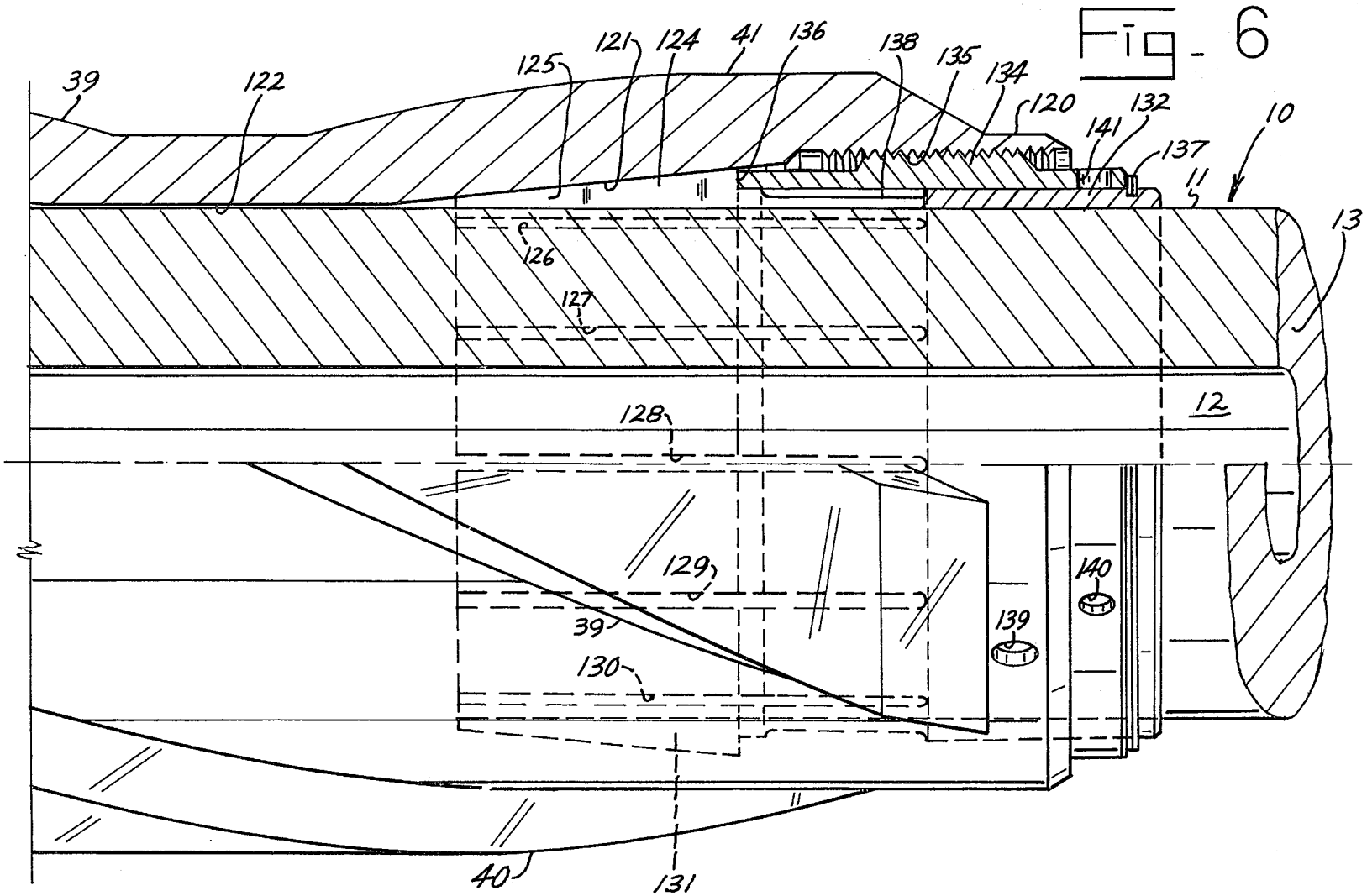

Referring now to FIG. 6 of the drawings, the apparatus embodiment therein shown includes a stabilizer body 120, which is tubular and which has a beveled interior relief or recess 121 opening toward each end.

The central portion 122 fits around the drill collar 10 with some clearance and the outwardly beveled recesses 121 extend therefrom to the upper and lower ends of the stabilizer sleeve 120. A wedge ring 124 is disposed in each relief portion 121 of the apparatus. Ring 124 has equally circularly spaced slots therearound, as indicated by reference numerals 125–131. The portion 132 is not slotted. An outwardly threaded ring shaped drive screw 134 is screwed into end threads 135 at the interior of each end of the stabilizer sleeve or body 120. Each drive screw 134 is disposed between a shoulder 136 of a wedge ring and one or more Spirolox split ring retainers 137 disposed in an annular recess around the end of the wedge ring 124. The slots 125–131 and identical slots around the remainder of wedge ring 124 (not shown) provide flexibility for the wedging portions of the wedge rings 124. The wedge rings 124 are thinned at recesses 138 annularly therearound. Cylindrical spanner wrench openings 139–141 are provided in the stabilizer sleeve 120 and in the drive screw 134 for rotation thereof by suitable spanner wrenches.

As will by now be evident, the wedge portions of the wedge rings 124 disposed at the beveled reliefs 121 will be driven toward the center of the stabilizer sleeve from each end thereof to cause clamping forces on the drill collar 10 when the drive screws 134 are screwed into the threads 135 at each end of the apparatus. Opposite movements of the drive screws will cause release of the wedges in a positive fashion since the Spirolox retainer rings 137 will draw the wedge rings out of contact with the beveled relief portions 121 when the drive screw is turned in a releasing direction. The wedging actions at each end of the stabilizer sleeve firmly clamp the stabilizer sleeve to the drill collar at any location along the length thereof so that the stabilizer sleeve becomes fixed against both longitudinal motion and rotative motion. Upon release of the wedging action as heretofore described, the stabilizer sleeve may be moved to another location and again clamped in place.

It will be clear from the descriptions of the embodiments depicted herein, that each embodiment is capable of being clamped to the drill collar at any location along the drill collar length, and is capable of being released and moved to another location, or removed from the drill collar if desired. Each form of stabilizer has a positive clamping action with respect to the drill collar, and each has a positive releasing action whereby no difficulties will be encountered for movement of the stabilizer or removal thereof.

While preferred embodiments of the apparatus according to the invention have been described and shown in the drawings, many modifications thereof may be made by persons skilled in the art without departing from the spirit of the invention, and it is intended to protect by Letters Patent all forms of the invention falling within the scope of the following claims.

I claim:

1. Stabilizer apparatus adapted for releasable connection around a drill collar, to centralize and guide the drill collar in a well, comprising tubular sleeve means having passage means therethrough end to end, a drill collar received through said passage means, connection means having movable clamping means disposed substantially entirely within said sleeve for forming, when actuated, a releasable clamped engagement between said sleeve and said drill collar, actuating means for forceably driving said clamping means in one direction to form said clamped engagement and including means for forceably driving said clamping means in the opposite direction to positively release said clamped engagement.

2. The combination of claim 1, said connection means including at least one flushly disposed plurality of frustoconical spring washers, means to reform said spring washers toward planar configurations thereby increasing their radial extents to dispose them between said sleeve and said drill collar in clamped engagements, and means for returning said spring washers to frustoconical form to release said clamped engagements.

3. The combination of claim 2, there being two said pluralities of flushly disposed frustoconical spring washers, one said plurality of spring washers being disposed between said sleeve and said drill collar at one end portion of said apparatus, and the other said plurality of spring washers being disposed between said sleeve and said drill collar at the other end portion of said apparatus, each said plurality of spring washers being disposed with the apexes of the spring washers directed toward the center of the apparatus, said means for returning said spring washers to frustoconical form comprising piston means at the inner side of each said plurality of spring washers adapted to move the spring washers thereof toward said frustoconical form when fluid pressure is introduced to between said piston means.

4. The combination of claim 1, said connection means comprising a pair of outwardly tapered elastomeric tubular sleeve means disposed within corresponding tapered spaces between said sleeve and said drill collar, and means for compressing said elastomeric sleeve means axially to wedge them into said tapered spaces and to cause them to expand inwardly and outwardly whereby they are clampingly engaged against said sleeve and said drill collar, and releasing means for driving said elastomeric sleeve means toward the larger ends of said tapered spaces to release them from said clamped engagements.

5. The combination of claim 4, said means for compressing said elastomeric sleeve means axially comprising a threaded driver ring screwed into each end of said sleeve, said releasing means comprising means for introducing pressured fluid to between the inner ends of said elastomeric tubular sleeve means.

6. The combination of claim 1, said connection means comprising helical spring means which normally has an inner diameter smaller than the exterior diameter of said drill collar and is clampingly engaged therearound, means connecting said spring means to said sleeve, and means for compressing said spring means along its helical length to expand it to release the clamped engagement thereof with said drill collar.

7. The combination of claim 6, said helical spring means having terminal helical end portions and a central angular connecting portion, said central angular connecting portion being disposed in a slot provided between the spaced ends of a central split anchor ring fixed to said sleeve, said means for compressing said spring means along its helical length to expand it comprising outwardly threaded ring means screwed into the opposite ends of said sleeve and having shoulder means for engaging the opposite ends of said spring means.

8. Stabilizer apparatus adapted for releasable connection around a drill collar, to centralize and guide the drill collar in a well, comprising tubular sleeve means having passage means therethrough end to end, a drill collar received through said passage means, connection means disposed substantially entirely within said sleeve for forming a releasable clamped engagement between said sleeve and said drill collar, said connection means comprising annularly beveled first surface means within said sleeve, and oppositely beveled second surface means slidably movable toward and away from said first surface means, means for moving said second surface means forceably toward and away from said first surface means, said first and second surface means providing a wedging clamping force between said sleeve and said drill collar to fix them together when said first and second surface means are moved forceably together, movement of said second surface means away from said first surface means causing release of said clamping force whereby said sleeves may be moved along said drill collar.

9. The combination of claim 8, said beveled first surface means being provided on two first ring means each disposed around said drill collar one at each end portion of said apparatus and each fixed against inward movement by central sleeve means disposed about said drill collar, said second surface means being provided by two second ring means each disposed adjacent a said first surface means, threaded ring means screwed into each end of said sleeve and each adapted to be screwed against a said second ring means to forceably move the second ring means against a said first ring means, lock wire means removably received in registered grooves around said central sleeve means and said sleeve to hold said central sleeve means stationary with respect to said sleeve, piston means disposed past said first ring means to against each said second ring means whereby introduced through said registered grooves pressured fluid may be introduced to between said piston means to force said second ring means away from said first ring means and thereby providing said means for positively releasing said clamped engagement to release said sleeve from said drill collar.

10. The combination of claim 8, said first beveled surface means being provided one at each end portion of said sleeve interior, said second beveled surface means being provided by two wedge rings one at each end portion of said apparatus outward of said first beveled surface means, each said wedge ring having a beveled end portion and a sleeve end portion, outwardly threaded ring means screwed into each end of said sleeve to drive each said wedge ring forceably against a said first beveled surface means to cause clamping force between said sleeve and drill collar, each said wedge ring having outwardly projecting means to engage said outwardly threaded ring means when said outwardly threaded ring means is screwed out of an end of said sleeve to thereby withdraw said wedge rings away from said first beveled surface means to release said clamping force between said sleeve and drill collar and thereby to provide said means for positively releasing said clamped engagement to release said sleeve from said drill coller.

11. The combination of claim 1, said connection means comprising interbraided sleeve means formed by parallel crossed helically disposed wires, means fixed within said sleeve for anchoring each of said interbraided sleeve means, and means for moving one said anchoring means in a direction away from the other anchoring means to longitudinally tension said interbraided sleeve means to cause said interbraided sleeve means to be reduced in diameter to clamp against the outer surface of said drill collar, and means for moving said anchoring means toward one another to relax and diameterically expand said interbraided sleeve means to cause its release from said drill collar.

12. The combination of claim 11, said means for moving one said anchoring means away from the other anchoring means comprising outwardly threaded ring means screwed outwardly in one end of said sleeve, and means connecting said outwardly threaded ring means to one said anchoring means, said other anchoring means being fixed against movement toward said one anchoring means by shoulder means at the interior of said sleeve, said means for positively releasing said clamped engagement being provided by said outwardly threaded ring means when same is screwed inwardly in one end of said sleeve.

* * * * *